United States Patent [19]

Casutt

[11] 4,129,248

[45] Dec. 12, 1978

[54] FOLDING BOX FOR CONTAINING AND DISPLAYING ARTICLES SUCH AS FRUITS AND VEGETABLES

[76] Inventor: Toni Casutt, Kirchweg 46, 8102 Oberengstringen, Switzerland

[21] Appl. No.: 810,740

[22] Filed: Jun. 28, 1977

[30] Foreign Application Priority Data

Jul. 6, 1976 [CH] Switzerland ..... 8664/76

[51] Int. Cl.[2] ..... B65D 5/36

[52] U.S. Cl. ..... 229/41 B

[58] Field of Search ..... 229/41 B, 41 R

[56] References Cited

U.S. PATENT DOCUMENTS

| | | | |
|---|---|---|---|
| 2,066,753 | 1/1937 | Weiss | 229/41 B |
| 2,331,582 | 10/1943 | Trost | 229/41 B UX |
| 2,472,698 | 7/1949 | Edtmiller | 229/41 B X |
| 2,572,123 | 10/1951 | Edtmiller | 229/41 B X |
| 2,593,773 | 4/1952 | Leukoff | 229/41 B |
| 2,634,900 | 4/1953 | Leukoff | 229/41 B |
| 3,942,711 | 3/1976 | Desmond et al. | 229/41 B X |

*Primary Examiner*—Davis T. Moorhead
*Attorney, Agent, or Firm*—Flynn & Frishauf

[57] ABSTRACT

Bottom parts, overlapping on a longitudinal median strip and connected at bending lines with the long sidewalls of a folding box, are attached to the short sidewalls by connection flaps which have triangular ears glued to the adjacent short sidewall halves. The triangular adhering ears are bounded by 45° fold lines from the remainder of the connecting flap. The lower bottom part has a shallow oblique cutout at each end with its apex on the folding line between it and the connecting flap, so that the upper bottom part will ride on it easily as the box is set up while blunt corners on the leading edge of the oblique cut-out press in to provide snap action as the box is set up by inward pressure on the short sidewalls. In the folded condition, the sidewalls are folded together along the midline of the narrow walls. The two bottom parts are fastened together by a sticking strip edge along the middle. The lower bottom part bends on a folding line at the edge of this strip as the box is set up.

8 Claims, 8 Drawing Figures

FOLDING BOX FOR CONTAINING AND DISPLAYING ARTICLES SUCH AS FRUITS AND VEGETABLES

This invention relates to a folding box, particularly for holding and displaying articles such as fruits and vegetables, the box having a first pair of parallel sidewalls, and also a second pair at right angles to the first, and having two bottom parts. Each of the walls of the second pair has a folding line at about its middle that enables the box to be folded together flat. Bending or folding lines in folding cardboard boxes are provided by weakening the material some way without severing it and such a linear weakened portion may descriptively be referred to as a bending line, when the material is to be bent to form a corner edge and as a folding line when it is to be completely folded over.

Folding boxes are already known in various forms. In the usual folding boxes made of cardboard there is a problem that the bottom bends out of shape more or less strongly under the weight of the box contents. If the contents are somewhat moist, the shape stability of the carton is greatly reduced, so that finally the bottom breaks through and the contents drop out.

Efforts have been made to solve this problem, by making the bottom out of two overlapping parts. This has the disadvantage that in the manufacture of the blank a relatively large waste of cardboard results, because the portion of the blank that forms the bottom extends far out beyond the other parts. There is a further disadvantage that such folding boxes are folded over their diagonals and in their setup condition they have only little standing capability until they are filled, tending to fold up while empty.

In another known form of folding box, the bottom is made up of four parts, each connected, below, with one of the sidewalls through bending lines (places where cardboard is bent over along a line edge). The problem already mentioned, of the contents breaking through the bottom when they are or become moist, is not solved in this case, but only somewhat delayed in time. Moreover, such folding boxes do not lend themselves to being set up by machinery.

It is the object of the present invention to provide an inexpensive folding box in which the bottom will not break through under the weight of the contents under normal handling, even when the contents are moist, and, further, a box that can be made from a small blank with little cardboard waste and one that does not tend to fold back up in the set-up condition even when it is empty, and, finally, a box that lends itself readily to be set up by machinery at the place of filling, beginning with the folded condition in which it is delivered by the manufacturer.

SUMMARY OF THE INVENTION

Briefly, there are two bottom parts, one connected to each of the first pair of sidewalls by bending lines and there are provided foldable connection flaps between at least one of the bottom parts and the second pair of sidewalls, each connected by bending lines with the bottom part and one of the second sidewalls. The connection with the sidewalls is preferably by adhesion of bent over ears of the connecting flaps.

Both of the bottom parts are held together with adhesive along a median strip, and since at the same time one of the bottom parts (and preferably both of them) is connected with the sidewalls by connection flaps, there is a substantial reinforcement against undesired bending out of the bottom. Furthermore, for the containing capacity of the box, a relatively small amount of cardboard is necessary, and there is very little waste of material. The folding box lends itself readily to mechanical set-up by application of a light pressure on the narrow (second) sidewalls by hand or with simple mechanical means. In the set-up condition, the box has a good capability of standing up and it is also readily stacked.

The particular features by which the above-described construction is most advantageously obtained are best understood in the light of an illustrated description. The invention is described by way of the illustrative example with reference to the annexed drawings, in which.

Figure 1:
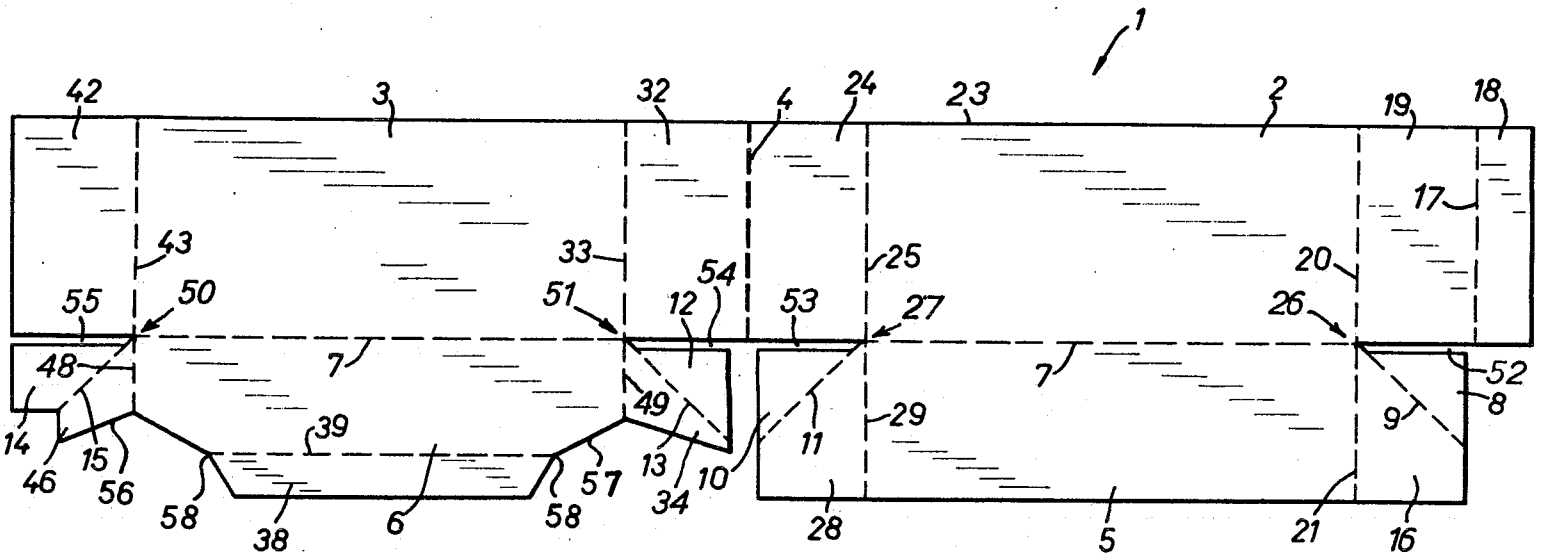
FIG. 1 is a plan view of a box blank lying flat.

FIG. 1 shows a box blank 1 for making a folding box that is open at the top, the blank being cut out of a strip of cardboard. This blank 1 has a long first sidewall 2 as well as another long sidewall 3, these two long sidewalls forming parallel walls in the set-up condition of the folding box. As later explained in more detail, these two long sidewalls 2 and 3 are later folded over along a main folding line 4, so that they lie one above the other.

A first bottom part 5 is connected to the long sidewall 2 along a bending line. The bending line 7 runs parallel to the upper edge 23 of the sidewall 2. A second bottom part 6 is connected along a bending line 7 with the other long sidewall 3. A connection flap 16 hangs from one end of the bottom part 5 along a bending line 21 running at right angles to the bending line 7, and beyond fold line 9 of the flap 16 there extends a triangular ear 8. The fold line 9 forms an angle of 45° to the bending line 7. A similar connection flap 28 is located at the other end of the first bottom part 5. This last connection flap 28 is hinged on the first bottom part 5 at a bending line 29 running at right angles to the bending line 7. A folding line 11 forms an angle of 45° to the bending line 7 and likewise bounds a triangular ear 10. A bending line 25 connects a short rectangular sidewall half 24 with the long sidewall 2. Another bending line 20 connects, at the other end of the long sidewall 2, another short rectangular sidewall half 19 with this long sidewall 2. The bending line 21 forms a straight extension of the bending line 20, whereas the bending line 29 forms a straight extension of the bending line 25.

A strip-shaped adhesive flap 18 extends away from the short sidewall half 19 and this strip-shaped sticking flap is connected to the short sidewall half 19 over a bending line 17 running parallel to the bending line 20. Between the ear flap 8 and the short sidewall half 19 there is a slit 52 extending all the way to the corner 26. Another slit 53 is located at the other end between the folding ear 10 and the short sidewall half 24 terminating at the corner 27.

At the corner 27 the bending lines 7, 25 and 29, the folding line 11 and the end of the slit 53 all come together. On the opposite side of the main folding line 4, thus to the left in FIG. 1, is another short rectangular sidewall half 32. This is connected with the long sidewall 3 through a bending line 33. At the other end of the long sidewall 3 there is still another short sidewall half 42, that is connected through a bending line 43 with long sidewall 3. The straight line extension of this bending line 43 is designated as the bending line 48. The folding line 15 runs at an angle of 45° to the bending line 7. Bending line 48 is shorter than half of the bottom width. Between the bending line 48 and the fold line 15 is a four-cornered connecting piece 46. The folding line 15 and a slit 55 running parallel to the bending line 7 respectively bound, on two sides, an ear 14. The slit 55, the fold line 15 and the bending lines 7, 43 and 48 come together in a corner 50. The connecting piece 46 is bounded on the outside by a shallow oblique cutback 46 leading into an obtuse angle the extremity of the bending line 48.

At the other end of the bottom part 6 there is a bending line 49 which is in effect a straight line continuation of the bending line 33. In the corner 51 the bending lines 7, 13, 33 and 49 intersect. Furthermore, a slit 54 ends in this corner 51, this slit separating the short sidewall half 32 from the folding ear 12. The folding line 13 forms an angle of 45 degrees with the bending line 7. The connecting piece 34 is bounded on the outside by an oblique cutback edge 57 that leads to an obtuse angle in the edge of the blank at the end of the bending line 49. A folding line 39 runs parallel to the bending line 7 near the edge of the bottom part 6 that is farthest from the bending line 7 and forms the boundary of a strip-shaped sticking edge 38 that is coated with adhesive.

When the blank is folded along the main bending line 4, the two long sidewalls 2 and 3 and likewise the short sidewall parts 24, 32 on the one hand and 19, 42 on the other are superimposed in registry with each other.

The bending lines can be either scored, stamped or perforated, so that the material along these lines has small resistance to bending compared to the unweakened material, so that the box can readily be bent up into the desired shape.

Figure 2:
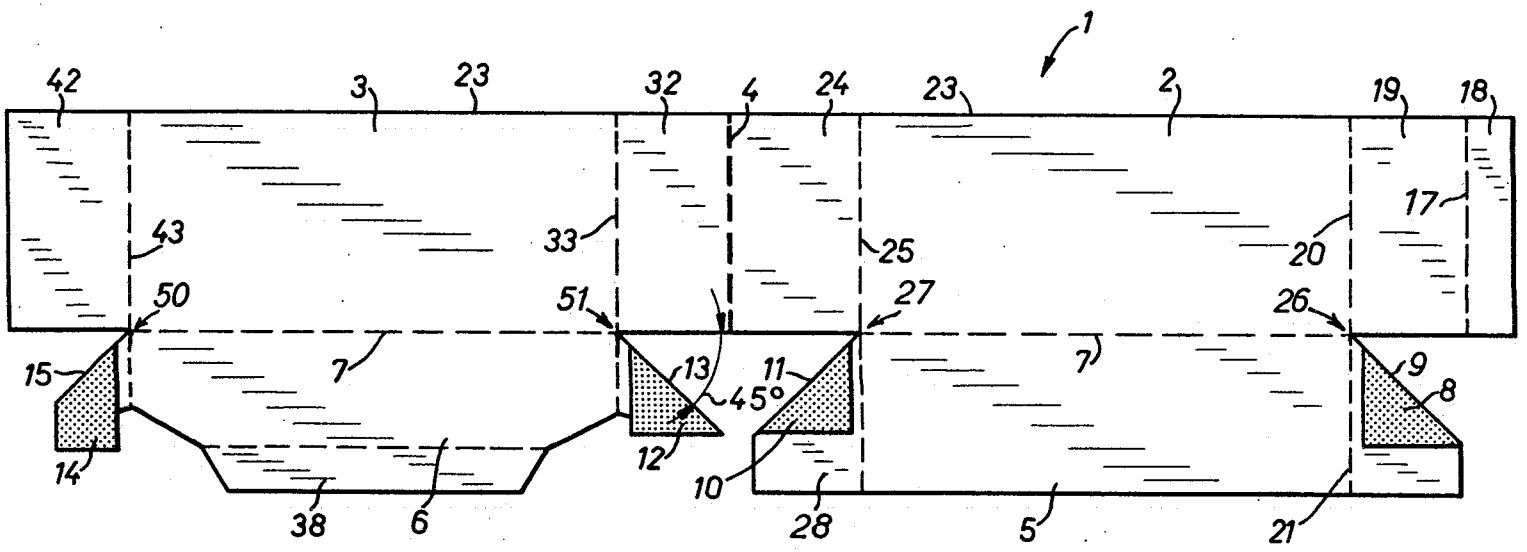
FIG. 2 shows the blank of FIG. 1 in which a portion of the locations for providing adhesive have been folded over.

In FIG. 2, a succeeding stage in the manufacture of the folding box is shown. Compared to FIG. 1, the folding ears 8, 10, 12 and 14 are each bent over by 180 degrees about the corresponding folding line edges 9, 11, 13 and 15 respectively. After this has been done, these bent over folding ears are coated with an adhesive on their respective exposed surfaces, as indicated in FIG. 2 by the dotted areas.

Figure 3:
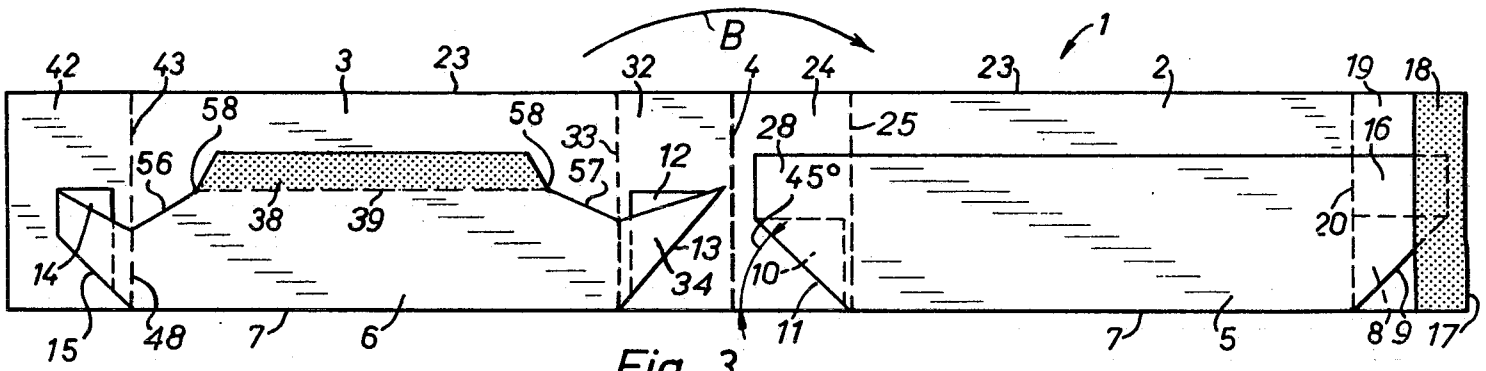
FIG. 3 shows the same box blank after the bottom parts have been folded over.

FIG. 3 shows the next following stage, in which now the two bottom parts 5 and 6 have been bent up along the bending line 7. When this is done the by now adhesive-coated ears 8, 10, 12 and 14 come into contact with the now facing short sidewall parts 19, 24, 32 and 42, respectively, and stick fast against them. The lateral sticking edge 18 is folded on itself by 180 degrees along the bending lines 17 and coated on the thus exposed surface with adhesive. However, it is not intended to remain bent over that far. The sticking strip 38 of the bottom part 6 that runs parallel to the bending line 7 is also coated with adhesive on the surface now lying above, as shown by the dotted area in FIG. 3.

Figure 4:
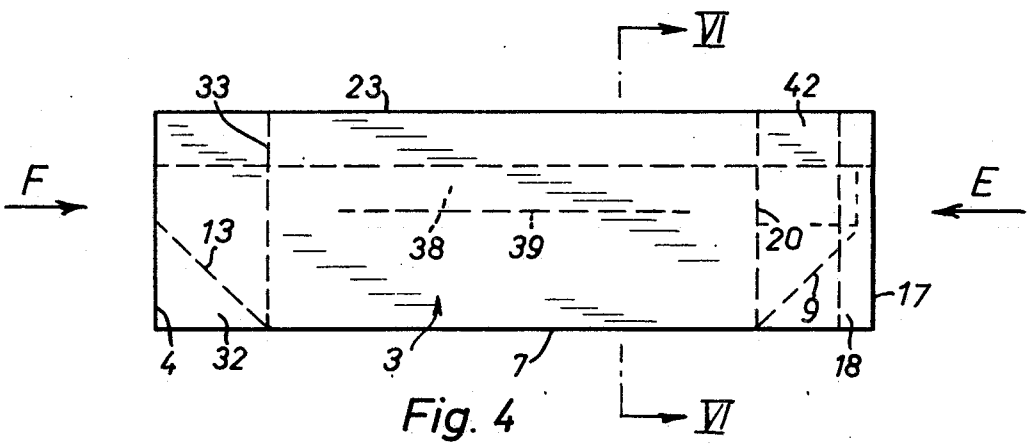
FIG. 4 is a plan view of the folding box made from the blank of FIG. 1 and folded flat.

Thereafter the two long walls 2 and 3 are folded together along the main bending line 4 in the direction of the arrow B, so as to be put into the position shown in FIG. 4. The sticking edge 18 is now affixed to the outer part of the short sidewall half 42 and the free ends of parts 5 and 6 are also connected to each other by the sticking edge 38. The folding box is now in the completed folded together condition as can be seen in FIG. 4 and can thereafter be set-up for use by applying light pressure in the direction of the arrows E and F on the two ends.

Figure 5:
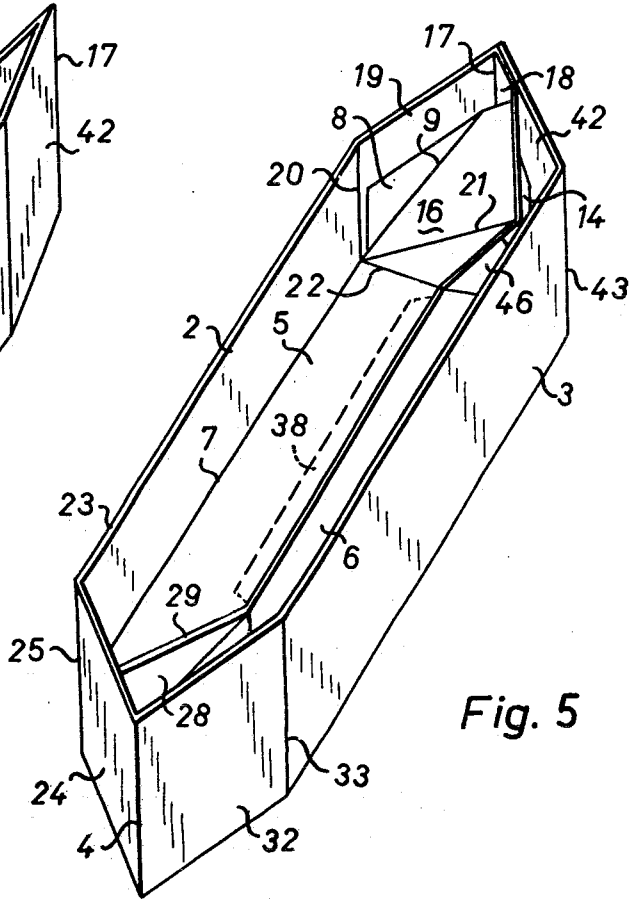
FIG. 5 is a perspective view of the same folding box in partly set-up conditions.
Figure 6:
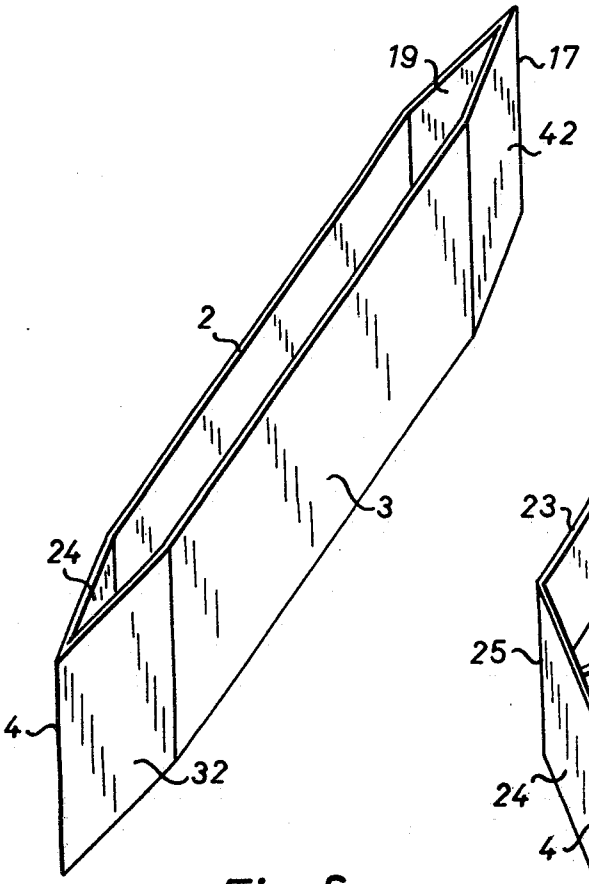
FIG. 6 is a perspective view of the folding box in its folded flat condition.

A partly set-up folding box is shown in FIG. 5. In the setting up of the folding box, the acute angle between the short sidewall parts 19, 42 and also between the short sidewall parts 24 and 32 becomes greater. In this process the ears 8, 11, 13 and 15 connected respectively to the short sidewall halves 19, 24, 32 and 42 press the bottom parts 5 and 6 downwards, which is required and constrained by the geometry of the obliquely running fold lines 9, 11, 13 and 15, respectively. The bottoms parts 5 and 6 cannot bend out of the horizontal position, because they are supported by the bends at the lines 21, 29, 48 and 49. During the setting-up process the oblique cutouts 56, 57 of the connection flaps 34 and 46 slide along the fold lines 9 and 11 at which the material is bent over in a right angle. The corners 58 between the bottom part 6 and the connection flaps 34 and 36 press at the beginning of the setting up operation tightly against the somewhat elastically bending bottom part 5 so that a snap effect follows as a result of which the folding box thereafter remains standing at its set-up condition.

Figure 7:
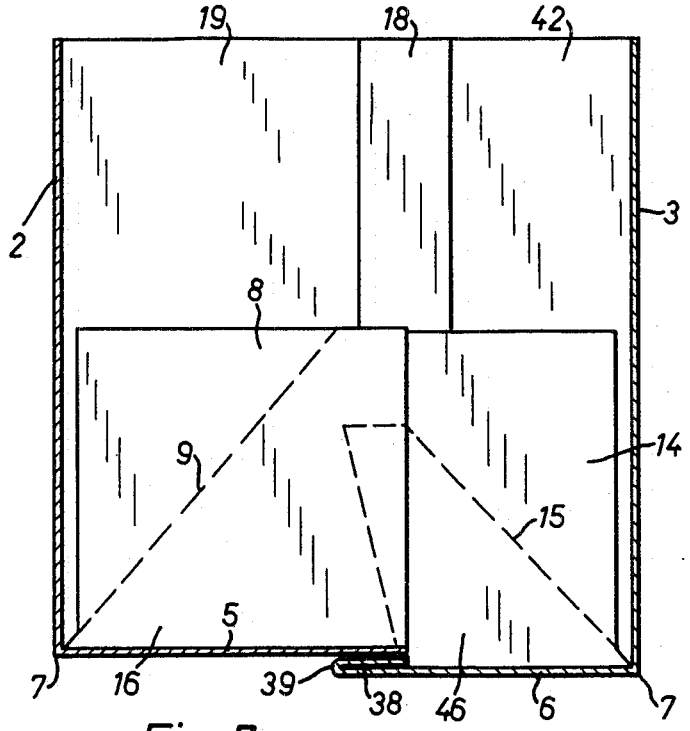
FIG. 7 is a cross section through a fully set-up folding box, in the plane of the line VI—VI of FIG. 4.
Figure 8:
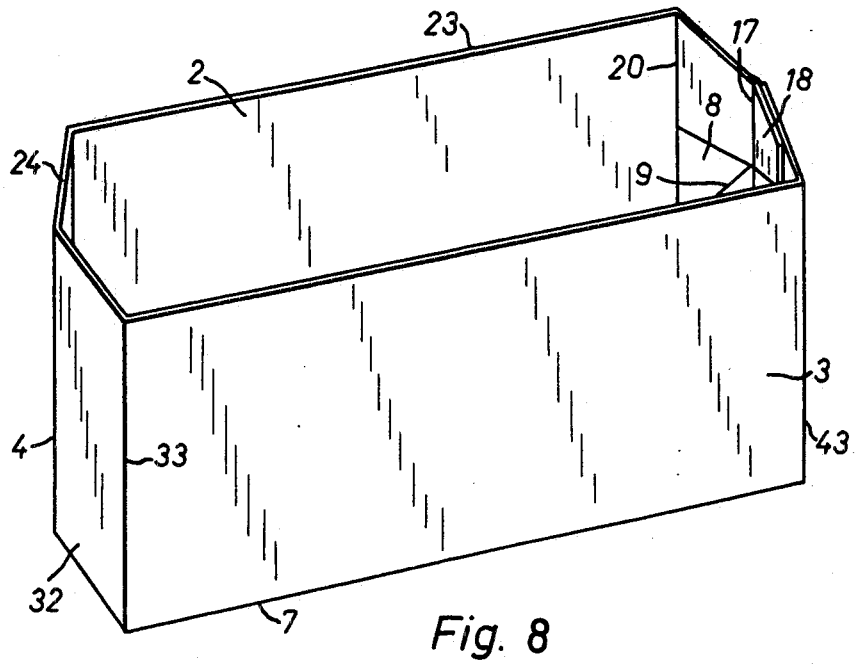
FIG. 8 is a perspective view of a fully set-up folding box of the kind shown in the other figures.

FIG. 7 and FIG. 8 show the folding box in its fully set-up condition, in which the short wall parts 17, 42 and 24, 32 have a slight upward buckle, that results from the remaining self-tension of the cardboard. It is however possible to give the folding box a shape in which the short sidewalls are exactly the right angle to the long sidewalls 2 and 3.

The overlapped location at the sticking edge 18 could also be shifted in the direction of the short sidewall part 42 in the sense it would make the part 18 wider and the sidewall part 42 correspondingly narrower, or on the other hand, the sticking edge 18 could be attached to the sidewall part 42. Furthermore it is possible to apply adhesive material, instead of at the locations shown by dotted areas in FIG. 2 and FIG. 3, at the correspondingly facing places of the other members of the joint, at the location where the adhesion is to take place. The proportions of the blank can be varied according to the desired container capacity and the kind of filling material for which the box is intended. In this manner, high or low boxes or long or short boxes can be made.

Since two bottom parts 5 and 6 respectively hang on the short sidewall parts 18, 24, 32, 42 in the box of the present invention, this folding box can carry a considerable weight of contents, which may be provided by fruit or vegetables, for example, without risk of the bottom opening downwards. The bending out of the bottom is still further opposed by the fact that the two bottom parts 5 and 6 are held together by adhesive in the middle portion between the ends where the connection flaps attach the bottom parts to the short sidewalls. In this middle portion, three layers of cardboard are superimposed so that an effect similar to that of a stiffening rib is produced.

In the setting up of the folded box by applying some pressure on the two ends in opposite direction as shown by the arrows E and F, the bottom parts are automatically pushed in theire horizontal or approximately horizontal position.

I claim:

1. A folding box useful for holding and displaying articles such as fruits and vegetables, comprising in combination:

two first sidewalls (2,3) each having a bottom part (5,6) connected thereto through hinge-like bending lines (7);

two second sidewalls (24,32; 19,42) each having approximately in the middle thereof a hinge-like folding line for enabling the sides to be folded together, and foldable connection flaps (8,16; 10,28; 12,34; 14,46) provided between at least one of the bottom parts (5,6) with which the flap is integral, and said second sidewalls (24,32; 19,42) in each case connected with the bottom part and a sidewall through hinge-like bending or folding lines (9,21; 11,28; 13,49; 15,48) and having an ear beyond one of said folding lines (9, 11, 13, 15) by which the flap is fastened in place, said bottom parts being fastened to each other along the area of an edge strip of one of said bottom parts hinged thereto along a folding line.

2. A folding box as defined in claim 1, in which said connecting flaps (8,16; 10,28; 12,34; 14,46) are connected integrally at bending lines of said bottom parts (5,6), and said ears thereof are affixed by adhesive respectively to the adjacent parts of said second side walls (24,32; 19,42), and in which said edge strip of said one bottom part is adhesively engaged to the other of said bottom parts by an adhesive substance provided therebetween.

3. A folding box as defined in claim 2, in which said adhesively engaged edge strip is bent back over about a folding line (39) that is parallel to the bending line (7) between said one bottom part (6) and the adjacent sidewall (3), whereby in an elongated region of the middle portion of the bottom there are, in the set-up condition of the box, three superimposed layers (FIG. 7).

4. A folding box as defined in claim 1, in which said foldable connection flaps have bending lines (9, 11, 13, 15) that run at an angle that at least approximates 45° through the bending line (7) between a bottom part (5,6) and respectively, the first sidewalls (2,3).

5. A folding box as defined in claim 2, in which each connecting flap (12,14) integral with the bottom part (6) that is provided with the adhesively engaged edge strip (38), which flap has an ear adhering to one of said second sidewall parts (32,42), meets said bottom part (6) in a bending line (49,48) that is shorter than half of the total width of the bottom of the box in its set-up condition.

6. A folding box as defined in claim 2, characterized in that in the blank from which it was made three bending or folding lines (7,9,20,21; 7,11,25,29; 7,13,33,49; 7,15,43,48) intersect at each of the corners (26,27,50,51) between bottom parts (5,6) and sidewall parts (19,24,32,42) and that furthermore at each of said corners a slit (52,53,54,55) terminates that separates the sidewall parts from the connection flaps.

7. A folding box as defined in claim 5, made from a blank in which two of said connection flaps have an obliquely cut back edge (56,57) leading into an inward obtuse angle having its apex on the bending line between the connection flap and the bottom part with which it is contiguous, said bottom part having an obliquely cut back part of its edge terminating in said obtuse angle apex.

8. A folding box as defined in claim 7, in which the two connection flaps having an obliquely cut back edge (56,57) are attached to the same one of said bottom parts (6), that one of said bottom parts being provided with an adhesively engaged edge strip (38) beyond a folding line (39) about which it is is bent or folded over on itself to present a sticking surface to the other of said bottom parts (5), and in which the corners (58) of the edge of said first-mentioned bottom part (6) which are respectively located at the ends of said edge-strip-defining folding line (39) press against the other bottom part (5) when the box is set-up, so that after some resistance is overcome in the setting-up of the box, the folding box tends to remain in the set-up condition, said corners (58) forming an obtuse angle in the outer contour of said first-mentioned bottom part (6) because of the folding or bending back of the edge-strip-carrying lip of the first-mentioned bottom part (6).

* * * * *